United States Patent [19]

Bruns et al.

[11] Patent Number: 4,902,988

[45] Date of Patent: Feb. 20, 1990

[54] CONTROL FOR FLEXIBLE PROBE

[75] Inventors: Robert W. Bruns, Campbell; Lorenzo J. Morris, Sunnyvale; John G. Weber, Boulder Creek; H. Taylor Howard, San Andreas, all of Calif.

[73] Assignee: Chapparal Communications, Inc., Portola Valley, Calif.

[21] Appl. No.: 302,367

[22] Filed: Jan. 27, 1989

[51] Int. Cl.[4] ..... H01P 1/165

[52] U.S. Cl. ..... 333/21 A; 343/786

[58] Field of Search ..... 333/108, 21 A, 248, 333/259; 343/786

[56] References Cited

U.S. PATENT DOCUMENTS

| | | | |
|---|---|---|---|
| 2,553,649 | 5/1951 | Garfitt | 333/259 X |
| 2,628,278 | 2/1953 | Zaleski | 333/21 A X |
| 4,829,313 | 5/1989 | Taggart | 333/21 A X |

*Primary Examiner*—Paul Gensler

*Attorney, Agent, or Firm*—Lewis H. Eslinger; Donald S. Dowden

[57] ABSTRACT

An electrically-conductive flexible probe is mounted within a wave guide that receives radio-frequency electromagnetic radiation. A leading portion of the probe has an orientation that is adjustable between two positions that are angularly displaced with respect to each other by 90°. A permanent bar magnet is connected to the leading portion of probe, and an electromagnet is mounted adjacent to the bar magnet so as to be capable of being magnetically coupled to the bar magnet. The electromagnet is electrically controllable so as to control the magnetic coupling between the bar magnet and the electromagnet, move the bar magnet selectively to one of the two angular positions, and thereby correspondingly move the leading portion of the probe and cause the wave guide to transmit radio-frequency electromagnetic radiation having a selected one of two polarizations in planes that are mutually orthogonal with respect to each other and reflect radio frequency electromagnetic radiation having the other polarization.

18 Claims, 3 Drawing Sheets

CONTROL FOR FLEXIBLE PROBE

BACKGROUND OF THE INVENTION

1. Field of the Invention

This invention relates to wave guides for radio-frequency electromagnetic radiation and, more particularly, to a microwave feed horn provided with novel means for controlling the plane of polarization of microwaves passing through the feed horn.

2. Description of the Prior Art

The electromagnetic spectrum is crowded with information signals broadcast by commercial radio and television stations, police and fire units, aircraft and air traffic controllers, ocean-going ships and harbor vessels, cellular telephone stations, military satellites, etc., and in order utilize the spectrum with better efficiency a number of techniques have been adopted. For example, commercial satellite signals are normally broadcast in polarized form, the plane of polarization being either horizontal or vertical. This enables receivers to discriminate between broadcast signals on the basis of polarization as well as frequency and therefore doubles the effective capacity of the spectrum. Of course, in order to be able to receive signals of both polarizations, the receiving apparatus must include a device that is adjustable so that it is capable of transmitting signals of either polarization. Signals having the polarization not selected by the device are reflected and are therefore not demodulated by the receiving apparatus.

A patent to Moeller et al. No. 3,024,463 discloses a feed mechanism by means of which microwave signals may be transmitted between a feed horn of circular cross section and a wave guide of rectangular cross section. The mechanism is capable of transmitting signals that are either linearly or circularly polarized. In the case of either polarization of radiation received by the feed horn, the radiation is linearly polarized at the rectangular wave guide.

A patent to Bleackley No. 3,296,558 discloses a wave guide for rotating the plane of polarization of a wave. The apparatus comprises metal rods mounted on a torsion wire and extending out from the wire. If the wires are caused to define a surface that twists along the length of the wire, the plane of polarization of electromagnetic radiation propagated through the wave guide can be rotated.

A patent to Raiman No. 4,503,379 discloses another form of probe for rotating the plane of polarization of microwave radiation propagated through a circular wave guide. The probe comprises a continuous, serpentine, electrically-conductive filament. The upstream end of the filament is rotatable and the downstream end is fixed. The rotatable end of the filament is adjusted to receive microwave radiation of a particular polarization. The probe rotates the plane of polarization of the transmitted radiation so that, at the downstream end of the probe, the plane of polarization of the propagated radiation is such that the radiation will pass through a rectangular wave guide coupled to the downstream end of the probe.

The means known heretofore for rotating the plane of polarization of a radio frequency electromagnetic wave propagated through a wave guide all suffer from certain drawbacks. A particular problem is that the means for rotating the leading end of the probe tends to be complicated, expensive to manufacture, slow in operation, prone to break down, and expensive to repair. In commercial apparatus for receiving and discriminating between electromagnetic radiation of different polarizations, it is important to be able to shift easily and reliably from reception of radiation having a first plane of polarization to reception of radiation having a second plane of polarization which is orthogonal to the first plane. It is also important that the apparatus be inexpensive, reliable, and easily repaired. Apparatus that is fully responsive to these commercial requirements has not yet been made available.

OBJECTS AND SUMMARY OF THE INVENTION

An object of the invention is to provide apparatus that overcomes the problems of the prior art noted above.

In particular, an object of the invention is to provide apparatus that can discriminate between electromagnetic radiation in the radio-frequency range having a first plane of polarization and electromagnetic radiation in the radio-frequency range having a second plane of polarization at right angles to the first plane and which can quickly and efficiently be switched so that it receives radiation polarized in either plane and reflects radiation polarized in the other plane.

Another object of the invention is to provide such apparatus in a form that is simple and inexpensive to construct, that seldom needs repair, and that, when in need of repair, can be repaired inexpensively.

The foregoing and other objects of the invention are accomplished by the provision of apparatus comprising wave-guide means for receiving radio-frequency electromagnetic radiation; electrically-conductive probe means mounted in the wave-guide means, at least a given portion of the probe means having an orientation that is adjustable between two positions angularly displaced with respect to each other by a given angle; first magnetic means connected to the given portion of the probe means; and second magnetic means mounted adjacent to the first magnetic means so as to be capable of being magnetically coupled to the first magnetic means; at least one of the first and second magnetic means being electrically controllable so as to control the magnetic coupling therebetween, move the first magnetic means selectively to one of the two angular positions, and thereby correspondingly move the given portion of the probe means and cause the wave-guide means to preferentially transmit radio-frequency electromagnetic radiation having a selected one of two polarizations in planes that are angularly displaced with respect to each other substantially by said given angle and preferentially reflect radio-frequency electromagnetic radiation having the other of said polarizations.

In accordance with another aspect of the invention, there is provided a method comprising the steps of: providing wave-guide means for receiving radio-frequency electromagnetic radiation; mounting electrically-conductive probe means in said wave-guide means in the path of said received electromagnetic radiation, at least a given portion of said probe means having an orientation that is adjustable between two positions angularly displaced with respect to each other by a given angle; attaching first magnetic means to said given portion of said probe means; mounting second magnetic means adjacent to the first magnetic means so as to be capable of being magnetically coupled to the first magnetic means; and electrically controlling at least one of the first and second magnetic means so as to control the magnetic coupling therebetween, move the first magnetic means selectively to one of said two angular positions, and thereby correspondingly move the given portion of said probe means to cause said waveguide means to preferentially transmit radio-frequency electromagnetic radiation having a selected one of two polarizations in planes that are angularly displaced with respect to each other substantially by said given angle and preferentially reflect radio-frequency electromagnetic radiation having the other of said polarizations.

A better understanding of the objects, features and advantages of the invention can be gained from a consideration of the following detailed description of the preferred embodiment thereof, in conjunction with the appended figures of the drawing.

DESCRIPTION OF THE PREFERRED EMBODIMENT

Figure 2:
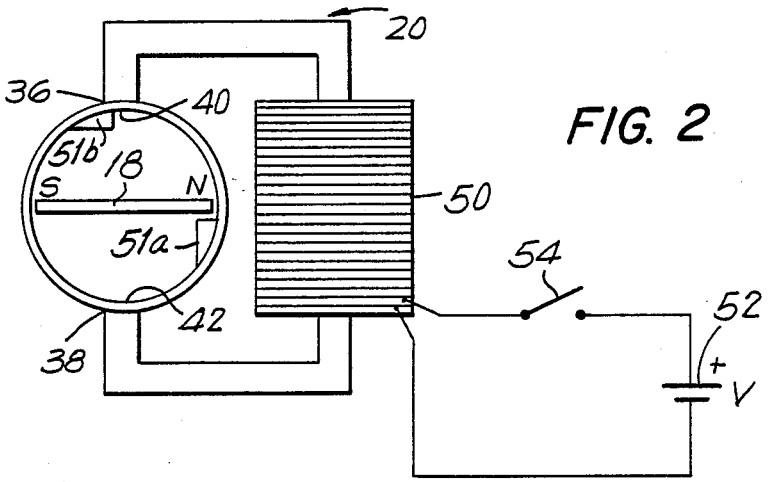
FIG. 2 is a view in cross section of apparatus constructed in accordance with the invention, the apparatus being shown in a deenergized condition.
Figure 3:
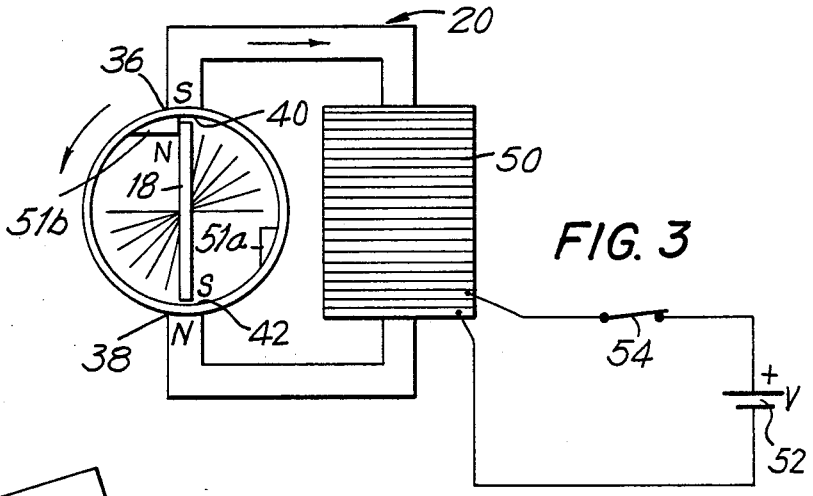
FIG. 3 is a view similar to FIG. 2 showing the apparatus in an energized condition.

The figures show apparatus 10 constructed in accordance with the invention for receiving radio-frequency electromagnetic radiation. The apparatus 10 comprises a wave guide 12 for receiving radio-frequency electromagnetic radiation and an electrically-conductive probe 14 mounted in the wave guide 12. At least a portion 16 of the probe 14 adjacent to the leading end thereof has an orientation that is adjustable between two positions angularly displaced with respect to each other by a given angle, usually 90°. For example, a first position is shown in FIG. 2 and a second position is shown in FIG. 3. These positions of the bar magnet are discussed in greater detail below.

A first magnetic means such as a bar magnet 18 is connected to the leading portion 16 of the probe 14, and a second magnetic means such as an electromagnet 20 is mounted adjacent to the bar magnet 18 so as to be capable of being magnetically coupled to the bar magnet 18. At least one of the first and second magnetic means 18, 20 is electrically controllable so as to control the magnetic coupling therebetween. Preferably, the magnetic means 18 is a permanent bar magnet, and the magnetic means 20 is an electromagnet which can be electrically controlled to exhibit or not exhibit the properties of a magnet. Under the control of the electromagnet 20, the bar magnet 18 can be moved selectively to one of the two angular positions shown in FIGS. 2 and 3 and thereby correspondingly move the leading or given portion 16 of the probe 14 and cause the wave guide to preferentially transmit radio-frequency electromagnetic radiation having a selected one of two polarizations in planes that are angularly displaced with respect to each other substantially by a given angle such as 90° and preferentially reflect radio-frequency electromagnetic radiation having the other of the two polarizations.

The apparatus is particularly adapted to receive transmissions from broadcast satellites, and the wave guide 12 comprises a feed horn including a conventional scalar ring 22 for receipt of radio-frequency electromagnetic radiation in the microwave range. The apparatus also comprises an electrically-conductive septum 24 mounted in the wave guide 12 in a fixed position and enabling transmission of radio-frequency electromagnetic radiation having a polarization in a given plane. The probe 14 is elongate and flexible and has a second portion 26 that is spaced apart from the leading or given portion 16 and rigidly connected to the septum 24.

The second or downstream portion 26 of the probe 14 remains stationary as the given or leading portion 16 moves between the two angular positions illustrated in FIGS. 2 and 3.

The probe 14 comprises a serpentine filament 28 that is planar in a condition of rest. One of the polarization planes that are angularly displaced with respect to each other is parallel to the plane of the septum 24 (i.e., to the given plane referred to above).

Usually, as indicated above, the angular displacement between the planes of polarization of the radio-frequency electromagnetic radiation is substantially 90°. This provides maximum discrimination between signals that have the same or overlapping frequency but are differently polarized.

The probe 14 is conventional per se and is disclosed in the Raiman Pat. No. 4,503,379 cited above. It comprises a plurality of legs 30 and a plurality of interconnections 32 interconnecting the legs 30 to form a serpentine filament 28. The structure thus formed is flexible and elastic, and the legs 30, interconnections 32, and the serpentine structure considered as a whole are elongate in directions that are respectively transverse, parallel, and parallel to a direction of propagation of radio-frequency electromagnetic radiation through the wave guide 12. Thus approximately equal angular displacements are maintained between adjacent legs 30. When the portion 16 of the probe 14 is in position of FIG. 2, the equal angular displacements referred to above are substantially zero. When the portion 16 of the probe 14 is in the position of FIG. 3, the equal angular displacements referred to above are substantially equal in total to the angle between the leading portion 16 of the probe 14 in position of FIG. 2 and the same portion 16 in the position of FIG. 3.

The electromagnet 20 is mounted outside the wave guide 12 and comprises a core 34 having a pair of ends 36, 38. The ends 36, 38 are positioned adjacent to the wave guide 12 at respectively diametrically opposite positions thereof, as FIGS. 2 and 3 illustrate.

The probe 14 is elastic, as indicated above, and the diametrically opposite portions 40, 42 of the wave guide are selected so that, upon energization of the electromagnet 20, the permanent bar magnet 18 moves from the angular position illustrated in FIG. 2 to the angular position illustrated in FIG. 3. Upon deenergization of the electromagnet 20, the permanent bar magnetic 18 returns elastically to the angular position illustrated in FIG. 2.

The diametrically opposite portions 40, 42 of the wave guide 12 are selected so that, upon energization of the electromagnet 20, a magnetic force and an elastic restoring force acting on the permanent bar magnet 18 are in balance when the permanent bar magnet 18 is in the angular position illustrated in FIG. 3.

In a practical case, the elastic restoring force of the probe 14 will prevent the portion 16 from aligning perfectly with the ends 36, 38 of the core 34 of the electromagnet 20. Thus if the ends 36, 38 are positioned exactly 90° away from the position o the bar magnet 18 in a deenergized state of the electromagnet 30, the bar magnet 18 will pivot through an angle slightly less than 90°, for example 87° or 88°, when the electromagnet 20 is energized (the exact value of the angle of rotation will depend in part on the magnetic flux and the stiffness of the probe 14, as those skilled in the art will understand).

Figure 4:
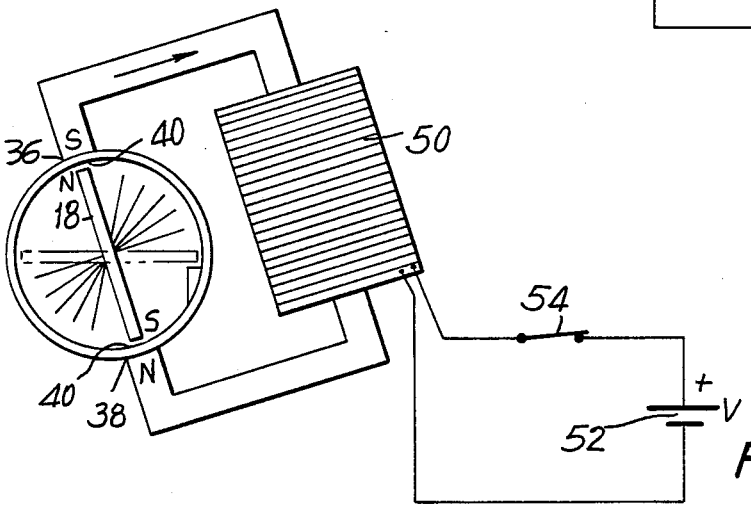
FIG. 4 is a view showing a modification of the apparatus of FIGS. 2 and 3.

In order to ensure that, upon energization of the electromagnet 20, the bar magnet 18 pivots through 90°, the ends 36, 38 of the core 34 of the electromagnet 20 may be positioned at an angle that is slightly larger than 90° with respect to the rest position of the bar magnet 18. This is illustrated in FIG. 4 in exaggerated form and discussed in more detail below.

Figure 1:
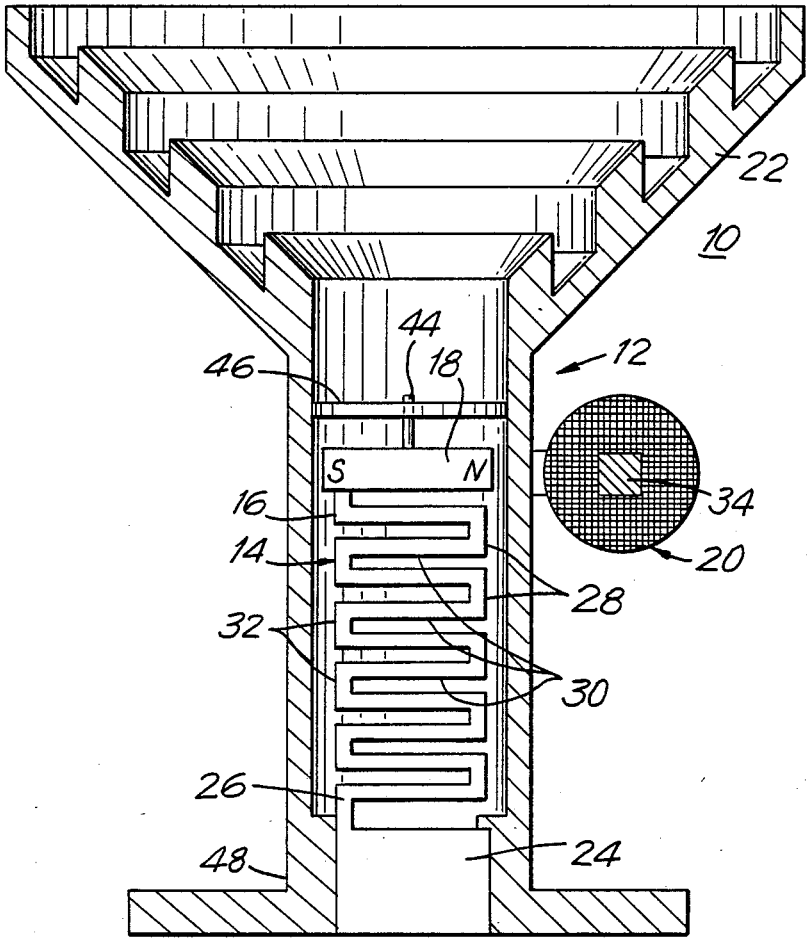
FIG. 1 is a view in axial section of apparatus constructed in accordance with the invention.

The serpentine probe 14 is placed within the wave guide 12 and supported at its leading end by means of a pin 44 and retainer 46 (FIG. 1). The leading end 16 of the probe 14 is free to rotate about the axis of the pin 44. The retainer 46 is secured to the wave guide 12 at diametrically opposite points thereof.

The septum 24 is made of thin metallic material (for example, about 0.005" thick) and normally lies in a plane. The septum 24 is transparent to microwave signals polarized so that the electric vector oscillates in a plane that is normal to the plane in which the septum 24 lies. Thus the septum 24 does not interfere with the transmission of such signals through the rectangular wave guide 48. Reception microwave signals polarized in different planes is accomplished by rotation of the free end 16 of the serpentine probe 14. See the U.S. Pat. to Raiman No. 4,503,379 described above.

A coil 50 consisting of multiple turns of thin-gauge wire is wound around the magnetically permeable iron or otherwise ferromagnetic core 34.

The magnetic rotor formed by the permanent bar magnet 18 may be magnetically polarized as indicated in the figures of the drawing or in an opposite sense and in fact no permanent magnetic field is required. However, introduction of the permanent magnetic field has certain benefits, as described in more detail below. In the preferred embodiment, the magnetic rotor is a piece of moldable ferromagnetic material that is injection-molded in situ around the upper part of the serpentine probe 14 and permanently magnetized.

FIG. 2 is a cross sectional view of the apparatus 10 showing the rotor 18 in the position it occupies when the coil 50 is in a deenergized state. The serpentine probe 14 is made from a flat piece of sheet metal and will stay in or return to its flat state in the absence of an external force applied thereto. In this case no rotation of the plane of polarization of radio-frequency electromagnetic radiation transmitted through the wave guide is realized. Signals whose electric field is perpendicular to the serpentine probe 14 at each point of the probe 14 pass unimpeded through the feed. Since the leading end of the serpentine probe 14 is free to rotate, it will tend to oscillate about the axis of the pivot pin 44 when the apparatus 10 is switched from an energized to a deenergized state or vice versa. Stops 51*a* and 51*b* can be added to restrict this oscillation and halt it quickly when the leading end of the probe 14 moves in response to either energization or deenergization of the coil 50. Any other suitable damping means can be employed, as those skilled in the art will readily understand.

FIG. 3 shows the apparatus 10 in its energized condition. Here the serpentine probe 14 again accepts microwave signals whose electric field is perpendicular to its first (upstream) element. However, in this case the signal is rotated 90° as it passes axially through the circular wave guide to the rectangular wave guide.

Constructing the rotor out of a permanent magnet offers two important advantages. First, the direction of rotation of the rotor in response to energization and deenergization of the coil 50 is known. When the coil 50 is energized, the rotor must turn in a predetermined direction (counterclockwise in FIG. 3, for example) so as to align, by rotation through the smallest angle, the north pole of the permanent magnet with the south pole of the electromagnet and the south pole of the permanent magnet with the north pole of the electromagnet. When the coil 50 is deenergized, the elastic restoring force of the probe 14 rotates the rotor clockwise to the position of FIG. 2. If the rotor is constructed from a magnetically permeable but not permanently magnetized material, the neutral position of FIG. 2 is metastable. Upon energization, rotation of 90° in either direction may occur, since either direction of rotation will result in a minimum of magnetic reluctance. This precludes the use of stops and also means that the rotation of the rotor is always less than 90°.

FIG. 4 illustrates in exaggerated form how it is possible to ensure that the rotor, if permanently magnetized, can be made to rotate through a full 90° or even more. This is advantageous since the polarization of microwaves transmitted from commercial satellites is in planes that are mutually orthogonal. The correction shown in an exaggerated form in FIG. 4 makes it possible for the permanent bar magnet to assume two positions that are precisely at right angles to each other. If the core ends are offset from the bar magnet by an angle slightly greater than 90° from the relaxed position that is assumed by the bar magnet when the coil 50 is deenergized, the leading end of serpentine probe 14 can be brought to a full 90° rotation or even greater. Another advantage of employing a permanent magnet 18 as the rotor of the assembly is the reduction in magnetic flux required by the core assembly. The core and rotor form a magnetic circuit. The rotor turns to minimize the magnetic reluctance (reluctance is resistance to magnetic flux) and maximize the magnetic flux. The flux is greatest when the rotor has its own intrinsic flux because of its permanently magnetized state. This results in a lower power requirement for the electromagnet 20 and a more efficient coil and core assembly.

A battery 52 and switch 54 can be employed to energize and deenergize the coil 50 of the electromagnetic 20.

Thus there is provided in accordance with the invention a novel and highly effective microwave feed horn provided with novel means for controlling the plane of polarization of microwaves passing through the feed horn. The apparatus is inexpensive to manufacture, seldom breaks down, and, when it requires repair, can be repaired very inexpensively. It can change very quickly from reception of microwave radiation having one plane of polarization to reception of microwave radiation having a plane of polarization orthogonal thereto. It is idealy suited for the reception of commercial satellite broadcast signals.

Figure 5:
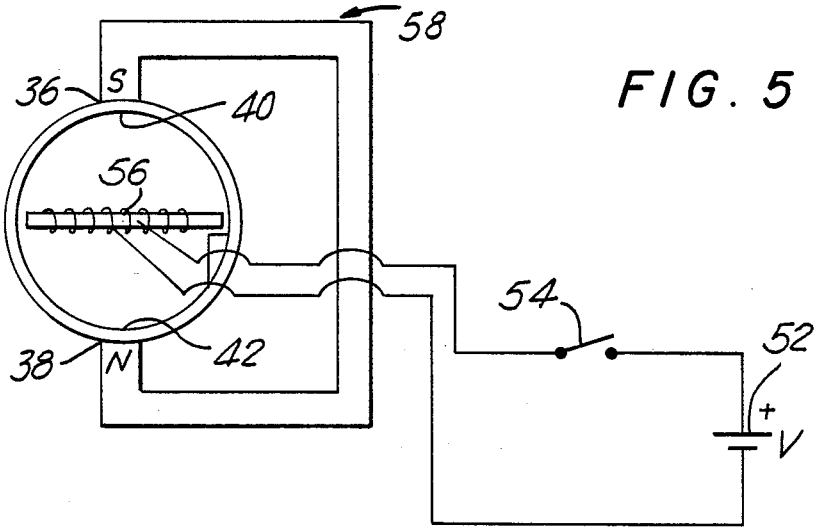
FIGS. 5 and 6 are views similar to FIGS. 2–4 showing further embodiments of the invention.
Figure 6:
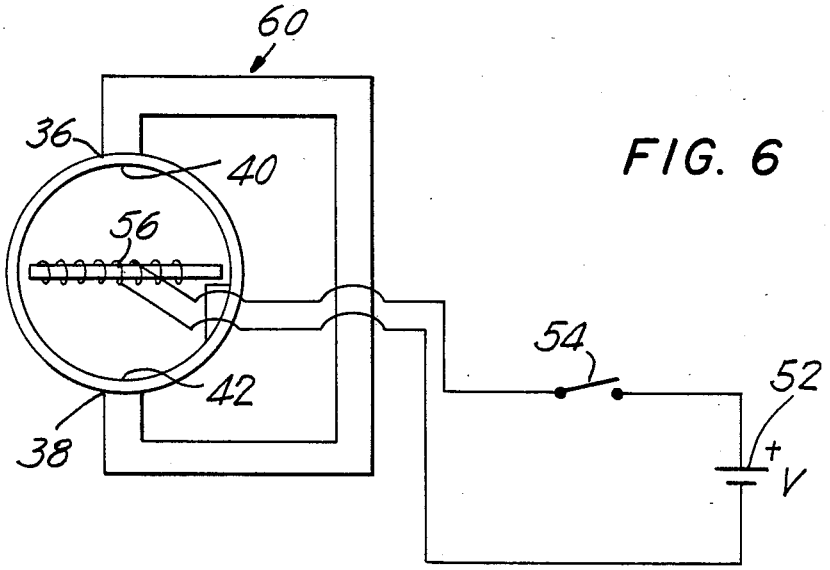

Many modifications of the preferred embodiment of the invention disclosed herein will readily occur to those skilled in the art. For example, while aluminum is a preferred material for construction of the feed horn, zinc or any non-ferromagnetic conductive material can be employed. Also, in principle the rotor can be an electromagnet and the external magnetic means can be a permanent horseshoe magnet, as shown in FIGS. 5 and 6. In FIG. 5, the first magnetic means comprises an electromagnet 56 and the second magnetic means comprises a permanent horseshoe magnet 58. In FIG. 6, the first magnetic means comprises an electromagnet 56 and the second magnetic means comprises nonmagnetized ferromagnetic material 60. Other modifications will readily occur to those skilled in the art. Accordingly, the scope of the invention should be determined only by the appended claims.

We claim:

1. Apparatus comprising:

wave-guide means for receiving radio-frequency electromagnetic radiation;

electrically-conductive probe means mounted in said wave-guide means, at least a given portion of said probe means having an orientation that is adjustable between two positions angularly displaced with respect to each other by a given angle;

first magnetic means connected to said given portion of said probe means; and second magnetic means mounted adjacent to said first magnetic means so as to be capable of being magnetically coupled to said first magnetic means;

at least one of said first and second magnetic means being electrically controllable so as to control the magnetic coupling therebetween, move said first magnetic means selectively to one of said two angular positions, and thereby correspondingly move said given portion of said probe means and cause said wave-guide means to preferentially transmit radio-frequency electromagnetic radiation having a selected one of two polarizations in planes that are angularly displaced with respect to each other substantially by said given angle and preferentially reflect radio-frequency electromagnetic radiation having the other of said polarizations.

2. Apparatus according to claim 1 wherein said wave-guide means comprises a feed horn and said radio-frequency electromagnetic radiation comprises microwaves.

3. Apparatus according to claim 1 further comprising an electrically-conductive septum mounted in said wave-guide means in a fixed position and enabling transmission of radio-frequency electromagnetic radiation having a polarization in a given plane, and wherein said probe means is elongate and flexible and has a second portion that is spaced apart from said given portion and rigidly connected to said septum so that said second portion remains stationary as said given portion moves between said two angular positions.

4. Apparatus according to claim 3 wherein one of said planes that are angularly displaced with respect to each other is parallel to said given plane.

5. Apparatus according to claim 3 wherein said probe means comprises a serpentine filament that is planar in a condition of rest.

6. Apparatus according to claim 1 wherein said given angle is substantially 90°.

7. Apparatus according to claim 1 wherein said first magnetic means comprises a permanent bar magnet and said second magnetic means comprises an electromagnet.

8. Apparatus according to claim 1 wherein said first magnetic means comprises nonmagnetized ferromagnetic material and said second magnetic means comprises an electromagnet.

9. Apparatus according to claim 1 wherein said first magnetic means comprises an electromagnet and said second magnetic means comprises a permanent horseshoe magnet.

10. Apparatus according to claim 1 wherein said first magnetic means comprises an electromagnet and said second magnetic means comprises nonmagnetized ferromagnetic material.

11. Apparatus to claim 1 wherein said probe means comprises a plurality of legs and a plurality of interconnections interconnecting said legs to form a flexible structure having a serpentine shape, said legs, interconnections, and structure of serpentine shape being elongate in directions that are respectively transverse, parallel, and parallel to a direction of propagation of radio-frequency electromagnetic radiation through said wave-guide means, thereby maintaining approximately equal angular displacements between adjacent legs, said equal angular displacements being substantially zero when said given portion of said probe means is in one of said positions and substantially equal in total to said given angle when said given portion of said probe means is in the other of said positions.

12. Apparatus according to claim 1 wherein said second magnetic means comprises an electromagnet mounted outside said wave-guide means and said electromagnet comprises a core having a pair of ends; said ends being positioned adjacent to said wave-guide means at respectively diametrically opposite portions thereof.

13. Apparatus according to claim 12, wherein said probe means is elastic and said diametrically opposite portions of said wave-guide means are selected so that, upon energization of said electromagnet, said first magnetic means moves from a first of said two angular positions to the other and, upon deenergization of said electromagnet, said first magnetic means returns elastically to said firs angular position.

14. Apparatus according to claim 12 wherein said diametrically opposite portions of said wave-guide means are selected so that, upon energization of said electromagnet, a magnetic force and an elastic restoring force acting on said first magnetic means are in balance when said first magnetic means is in said other angular position.

15. Apparatus according to claim 1 further comprising stop means for restricting oscillation of said first magnetic means when it moves to at least one of said angular positions.

16. Apparatus according to claim 1 further comprising stop means for restricting oscillation of said first magnetic means when it moves to either of said angular positions.

17. Apparatus according to claim 1 wherein said first magnetic means is formed of moldable ferromagnetic material injection molded around said given portion of said probe means.

18. A method comprising the steps of:

providing wave-guide means for receiving radio-frequency electromagnetic radiation;

mounting electrically-conductive probe means in said wave-guide means in the path of said received electromagnetic radiation, at least a given portion of said probe means having an orientation that is adjustable between two positions angularly displaced with respect to each other by a given angle;

attaching first magnetic means to said given portion of said probe means;

mounting second magnetic means adjacent to the first magnetic means so as to be capable of being magnetically coupled to the first magnetic means; and electrically controlling at least one of the first and second magnetic means so as to control the magnetic coupling therebetween, move the first magnetic means selectively to one of said two angular positions, and thereby correspondingly move the given portion of said probe means cause said waveguide means to preferentially transmit radio-frequency electromagnetic radiation having a selected one of two polarizations in planes that are angularly displaced with respect to each other substantially by said given angle and preferentially reflect radio-frequency electromagnetic radiation having the other of said polarizations.

* * * * *

UNITED STATES PATENT AND TRADEMARK OFFICE

CERTIFICATE OF CORRECTION

PATENT NO. : 4,902,988

DATED : February 20, 1990

INVENTOR(S) : Bruns et al.

It is certified that error appears in the above-identified patent and that said Letters Patent is hereby corrected as shown below:

On the title page, Item [75] and [73] should read --

[75] Inventors: Robert W. Bruns, Campbell; Lorenzo J. Morris, Sunnyvale; John G. Weber, Boulder Creek; H. Taylor Howard, San Andreas; Robert B. Taggart, Portola Valley, all of California.

[73] Assignee: Chaparral Communications, Inc. San Jose, California --.

Signed and Sealed this

Twenty-third Day of April, 1991

*Attest:*

*Attesting Officer*

HARRY F. MANBECK, JR.

*Commissioner of Patents and Trademarks*